US005314199A

United States Patent [19]

Olson et al.

[11] Patent Number: 5,314,199

[45] Date of Patent: May 24, 1994

[54] CONVERTIBLE IN-LINE ROLLER SKATES

[75] Inventors: Scott B. Olson, Minneapolis; Louis F. Polk, Excelsior, both of Minn.

[73] Assignee: O.S. Designs, Inc., Waconia, Minn.

[21] Appl. No.: 30,974

[22] Filed: Mar. 12, 1993

Related U.S. Application Data

[63] Continuation-in-part of Ser. No. 868,457, Apr. 14, 1992, Pat. No. 5,193,827.

[51] Int. Cl.[5] ..... A63C 1/02

[52] U.S. Cl. ..... 280/7.13; 280/11.22; 280/11.27

[58] Field of Search ..... 280/7.13, 11.22, 7.14, 280/11.23, 11.3, 11.26, 11.27

[56] References Cited

U.S. PATENT DOCUMENTS

| | | | |
|---|---|---|---|
| 28,509 | 5/1860 | Shaler | 280/11.22 |
| 97,075 | 11/1869 | Gibson | 280/7.13 |
| 441,841 | 12/1890 | Hatschek | 280/11.3 |
| 480,610 | 8/1892 | Nielson | 280/11.22 |
| 916,289 | 3/1909 | Fitzgerald | 280/11.22 |
| 938,168 | 10/1909 | Nolan | 280/7.13 |
| 954,993 | 4/1910 | Peters | 280/11.22 |
| 1,260,692 | 3/1918 | Madsen | 280/11.22 |
| 1,268,385 | 6/1918 | Paulsen | 280/11.22 |
| 1,428,210 | 9/1922 | Boche | 280/11.22 |
| 1,527,840 | 2/1925 | Chomin | 280/11.22 |
| 1,530,211 | 3/1925 | Siemnash | 280/7.13 |
| 1,572,567 | 2/1926 | Skorka | 280/11.22 |
| 1,604,643 | 10/1926 | Harlowe | 280/11.22 |
| 1,728,629 | 9/1929 | Sahlmann | 280/11.22 |
| 1,801,205 | 4/1931 | Mirick | 280/11.22 |
| 1,835,446 | 12/1931 | Tracey | 280/11.22 |
| 1,868,548 | 7/1932 | Turner | 280/11.22 |
| 1,988,055 | 11/1935 | Stein | 280/11.28 |
| 2,019,738 | 11/1935 | Smith | 280/11.22 |
| 2,048,916 | 7/1936 | Bentzlin | 280/11.22 |
| 2,145,219 | 1/1939 | Burton | 280/11.22 |
| 2,220,557 | 11/1940 | User | 280/11.22 |
| 2,244,719 | 6/1941 | Mansfield | 280/11.3 |
| 2,377,366 | 9/1945 | Paystrup | 280/11.23 |
| 2,412,290 | 12/1946 | Rieske | 280/11.22 |
| 2,548,391 | 4/1951 | Petrime | 280/7.13 |
| 2,644,692 | 7/1953 | Kahlert | 280/11.22 |
| 3,086,787 | 4/1963 | Wyche | 280/11.19 |
| 3,287,023 | 11/1966 | Ware | 280/11.22 |
| 3,387,852 | 6/1968 | De Sarro | 280/11.2 |
| 3,880,441 | 4/1975 | Silver | 280/11.22 |
| 3,901,520 | 8/1975 | McMahan | 280/7.13 |
| 3,918,729 | 11/1975 | Peters | 280/7.13 |
| 3,963,252 | 6/1976 | Carlson | 280/11.22 |
| 4,058,324 | 11/1977 | Dallaire | 280/11.22 |
| 4,108,450 | 8/1978 | Cote | 280/7.13 |
| 4,114,295 | 9/1978 | Schaefer | 36/100 |
| 4,323,259 | 4/1982 | Boudreau | 280/7.13 |
| 4,351,536 | 9/1982 | Sandino | 280/7.13 |
| 4,353,562 | 10/1982 | Tiefenthal | 280/7.13 |
| 4,382,605 | 5/1983 | Hegna | 280/11.22 |
| 4,492,385 | 1/1985 | Olson | 280/7.13 |
| 4,666,169 | 5/1987 | Hamill et al. | 280/11.23 |
| 4,699,390 | 10/1987 | Cote | 280/11.23 |
| 4,932,675 | 6/1990 | Olson et al. | 280/7.13 |
| 4,988,122 | 1/1991 | Saunders | 280/841 |
| 5,046,746 | 9/1991 | Gierveld | 280/11.22 |
| 5,092,614 | 3/1992 | Malewicz | 280/11.22 |
| 5,129,663 | 7/1992 | Soo | 280/7.14 |

*Primary Examiner*—Richard M. Camby

[57] ABSTRACT

An improved skate assembly which permits interchanging and reversing of ice blades and in-line rollers. The arrangement provides for such interchange through utilization of a pair of rotatable cams which are utilized to couple the blade support to the toe and/or heel of the boot. Also, an interlocking notch/projection may be employed to achieve secure mounting of the blade support subassembly to the boot. Also disclosed is an attachment mechanism which can be used by the hands, and which requires no external tooling.

33 Claims, 9 Drawing Sheets

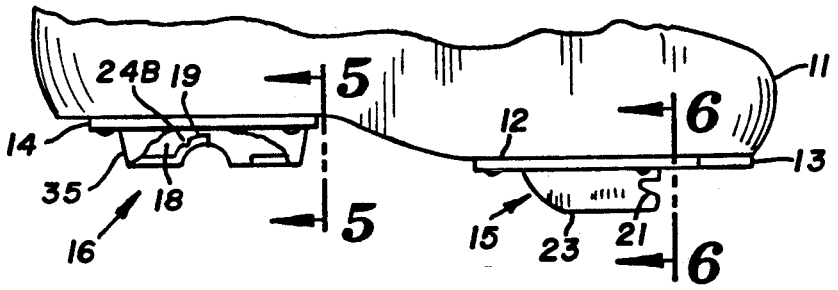
FIG.3
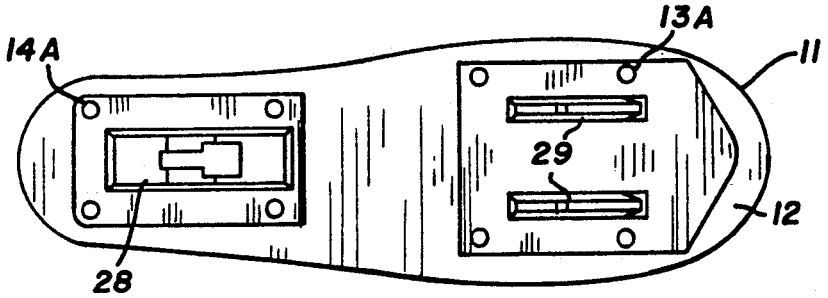
FIG.4
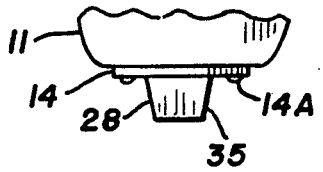
FIG.5
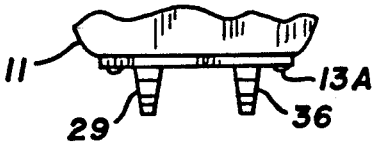
FIG.6
FIG.7
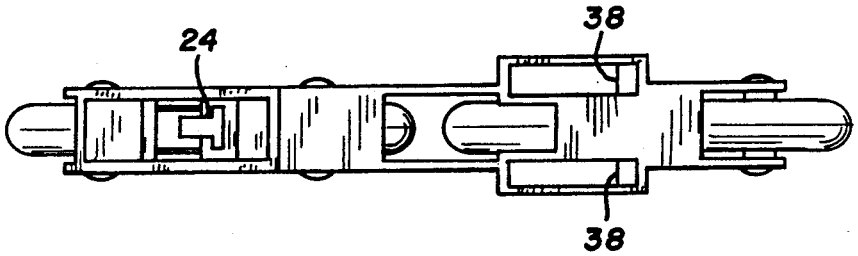
FIG.8
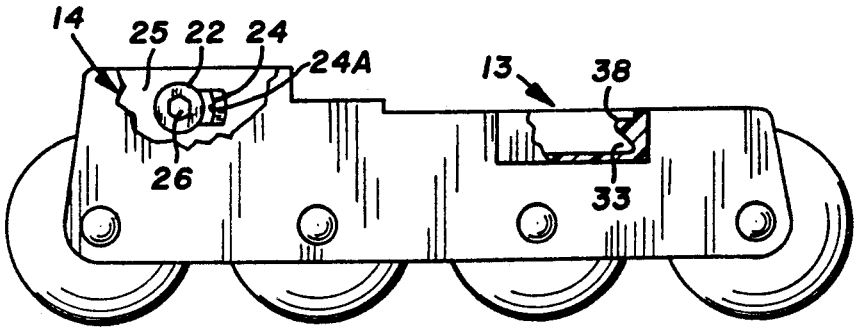

CONVERTIBLE IN-LINE ROLLER SKATES

CROSS REFERENCE TO RELATED APPLICATION

This is a continuation-in-part application of co-pending U.S. application Ser. No. 07/868,457 filed Apr. 14, 1992, U.S. Pat. No. 5,193,827, entitled Convertible In-Line Roller Skates.

BACKGROUND OF THE DISCLOSURE

The present invention relates to an improved skate assembly, and more particularly to an improved skate assembly which permits rapid, secure, and convenient interchange between ice blades and in-line rollers. The arrangement is designed to provide rigid, solid and secure attachment between the shoe and the blade element, regardless of whether the blade is an ice blade or an in-line roller frame. As a further feature of the invention, roller frames are adjustable in the length dimension to accommodate more than one shoe size.

Skates having interchangeable blades have been known in the past. These devices, having interchangeable features, have typically required extensive and/or cumbersome effort in order to accomplish and/or achieve the change. Furthermore, while utilization of one size blade to be accommodated on different shoe sizes has been accomplished with ice blades, such a feature has been achieved only with a certain amount of difficulty with rollers, particularly in-line rollers. The arrangement of the present invention, in addition to providing a secure and sound coupling between the shoe and the surface blade support member, also provides a means for adjusting the length of the in-line roller support frame so as to permit the utilization of a limited number of blade designs and manufactured lengths for accommodating a variety of shoe sizes. Such an arrangement permits the user to achieve a better balance along with a blade availability which can accommodate a variety of different preferences with respect to blade design, configuration, wheel count, and the like.

A common disadvantage in the utilization of interchangeable blades is that of achieving a firm attachment between the shoe and the blade frame. Specifically, it has been known that any looseness or play in the attachment can contribute to unsatisfactory performance. The present arrangement, by contrast, provides a firm, sound, and otherwise appropriate means for achieving secure releasable attachment between the shoe and the blade frame, with the in-line roller frame being designed to provide an adjustable length feature as well. Additionally, the design of the attachment pedestal secured to the shoe portion is at least partially in the form of an inverted truncated pyramid, thereby enhancing the stability and rigidity of the coupling arrangement.

Further, it is well-known that in-line skate wheel assemblies typically wear unevenly during use. Thus, it is desirable to provide a convertible skate assembly which provides for having a reversible blade assembly to extend the useful life of the wheel assembly. Further yet, there is a need to provide an attachment mechanism which does not require additional tools to facilitate adapting and securing the reversible blade assembly to the boot mounting brackets.

SUMMARY OF THE INVENTION

Briefly, in accordance with the present invention, a skate assembly is provided which is designed for rapid and secure interchange of the surface blade support, whether an ice blade or an in-line roller assembly. The skate assembly includes a shoe having a sole plate and toe and heel attachment pads secured to the plate, with a surface blade coupling means provided in a recessed zone of the toe and heel attachment. A cooperating and complementary coupling means is, of course, secured within the blade assembly in order to achieve and accomplish the interchangeable feature. The skate assembly further includes a blade support subassembly with a frame having the surface contact member secured to the base thereof, and with a blade support anchoring cam ramp in oppositely disposed relationship to the surface blade support. The frame means includes toe and heel pad receiving cavities, both of which are designed to firmly receive and retain the pads in firm but releasable disposition therewithin. At least one rotatable camming ramp or rail is provided in the assembly with a retaining notch formed therein, with the camming ramp or rail being rotatable about a camming axis, and being arranged to mate with a complementary and cooperating anchoring flange members secured to and disposed within at least one of the attachment pads, normally the heel pad. When a single camming rail or ramp arrangement is employed, the other attachment means is preferably in the form of a stationary camming ramp, with a single rod member or the like being held in place within the camming ramp or camming rail. Both heel and toe attachment pads include complementary pyramidal shaped elements so as to more securely retain the members together, even after long periods of extensive uses. If desired, the in-line roller member may be adjustable in its length dimension, thereby enabling a single in-line roller frame to accommodate a variety of shoe sizes without sacrificing balance and performance for the user.

In an alternative embodiment of the present invention, a boot is provided with a pair of substantially identical U-shaped mounting brackets each having a pair of side members defining a notch and adaptable to a wheel assembly. A pair of identical camming arrangements are provided at each end of the wheel assembly. When each cam arrangement is rotated, a pair of opposing flanges, one on each cam,, rotate within a pocket defined in each side plate comprising the wheel assembly and into a slot defined in the respective mounting bracket to secure the wheel assembly to the boot mounting bracket. The wheel assembly including the camming arrangements is symmetrically designed, and thus reversible. Each camming attachment means is provided with a mounting bolt having a lever or handle such that the bolt can be rotated without the need for additional tools. One can simply grasp the respective lever to facilitate rotation, wherein the handle has a locking position. This feature can be provided for both in-line roller blade accessories and for ice skating blade assemblies. The side members of the boot mounting brackets, and the pockets defined in the wheel assembly side plates, have a pyramid shape and conform to one another when the skate assembly is adapted to the boot mounting bracket to provide a rigid attachment.

Therefore, it is a primary object of the present invention to provide an improved skate assembly which provides interchangeability between an ice blade and an in-line roller, with the interchangeability feature being accomplished by a coupling operation.

It is yet a further object of the present invention to provide an improved interchangeable skate assembly which utilizes cooperating camming ramps or camming rails for achieving rigid attachment and interchangeability between blades, including ice blades and in-line rollers, and including, when desired, in-line rollers with length adjustability to accommodate varying shoe sizes.

It is still a further object of the present invention to provide an improved interchangeable skate assembly which has a reversible wheel assembly such that the wheel assembly can be reversed when wear develops at one end, thus extending the useful life of the wheel assembly.

It is still another object of the present invention to provide an improved interchangeable skate assembly which requires no additional tools to attach the skate assembly to the boot mounting brackets.

Other and further objects of the present invention will become apparent to those skilled in the art upon a study of the following specification, appended claims, and accompanying drawings.

IN THE DRAWINGS

FIG. 3 is a partial vertical sectional view taken along the line and in the direction of the arrows 3—3 of FIG. 2;

FIG. 4 is a bottom plan view of the shoe portion and illustrating the details of the attachment means;

FIG. 5 is a partial rear view of a portion of the shoe assembly, with a portion of the upper shoe being cut away, with FIG. 5 being taken along the line and in the direction of the arrows 5—5 of FIG. 3, and illustrating the detail of the heel attachment means;

FIG. 6 is a partial front elevational view of a portion of the shoe, taken along the line and in the direction of the arrows 6—6 of FIG. 3, and illustrating the camming rails;

FIG. 7 is a top plan view of the in-line wheel assembly or wheel carrier;

FIG. 8 is a side elevational view, partially in section, and showing the cam profile and notch engagement ramp, with the shoe portion being removed;

FIGS. 20A and 20B are partial side elevational views taken along line 20—20 shown in FIG. 19 illustrating the angular adjustment feature of the cam with the arcuate slot defined in the boot mounting bracket receiving the cam flanges, wherein FIGS. 20A and 20B show the skate assembly in the unlocked and locked position, respectively;

Figure 17:
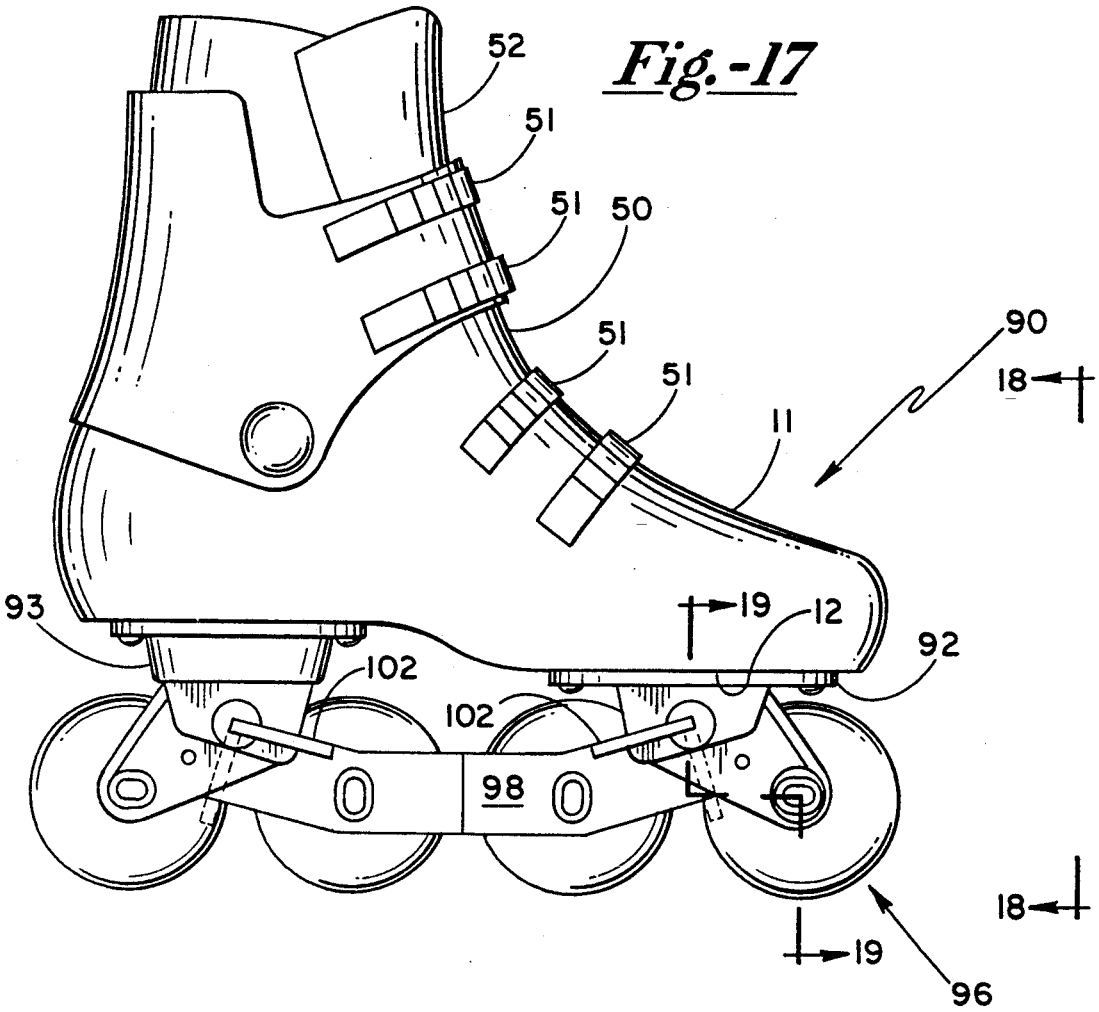
FIG. 17 is a side elevational view of a skate assembly in accordance with an alternative embodiment of the present invention, illustrating a symmetrically designed reversible wheel assembly requiring no external tools for securing the wheel assembly to the boot mounting brackets.
Figure 21:
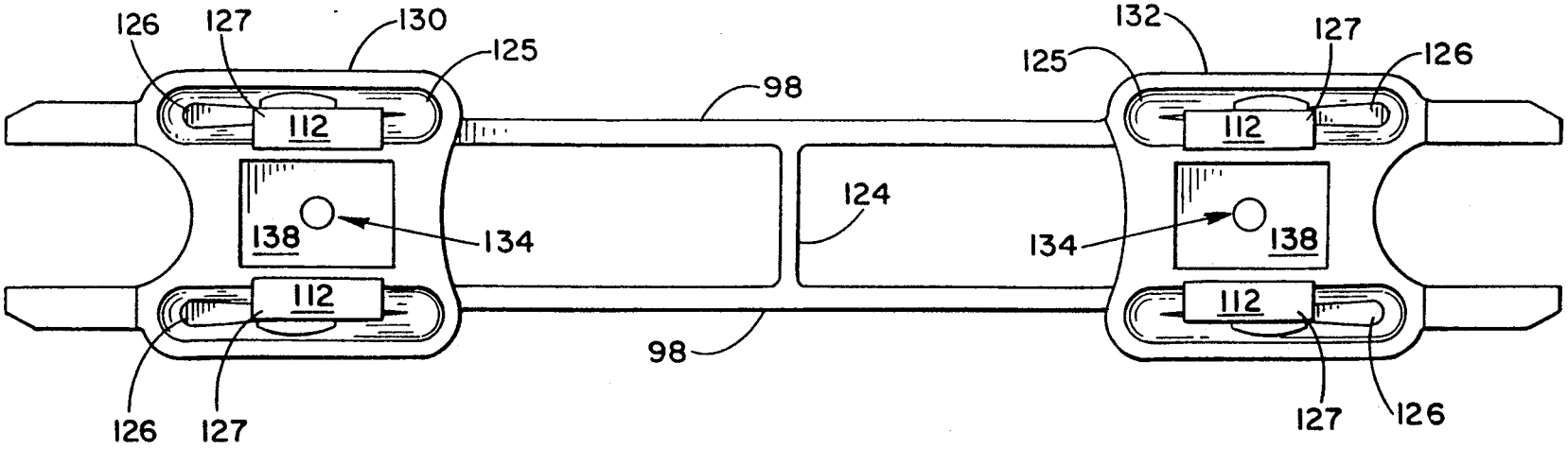
Figure 22:
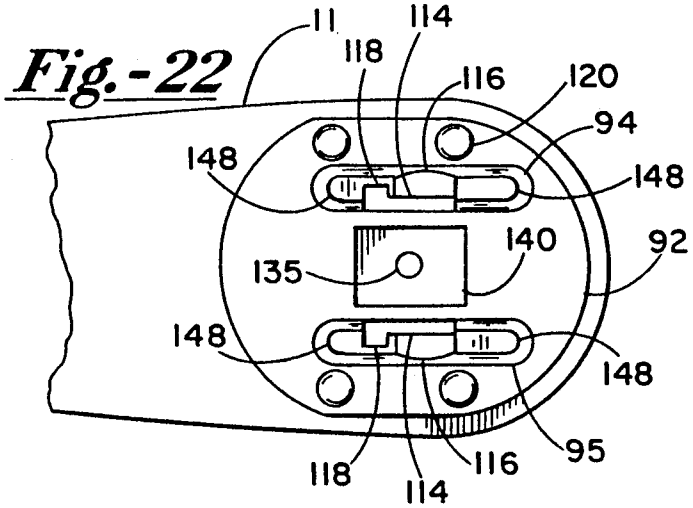

FIG. 21 is a top view of the skate assembly shown in FIG. 17 to further illustrate the symmetrical design of the wheel assembly, and the pyramid shaped recesses in the wheel assembly adapted to retain the cams and receive the boot mounting bracket; and FIG. 22 is a view of the bottom of the boot including the toe mounting bracket illustrating the L-shaped slot opening for receiving the rotated cam of the wheel assembly, wherein the mounting bracket side members have a generally elongated pyramid shape and are received into the conforming pyramid shaped recesses of the wheel assembly.

DESCRIPTION OF THE PREFERRED EMBODIMENT

Figure 1:
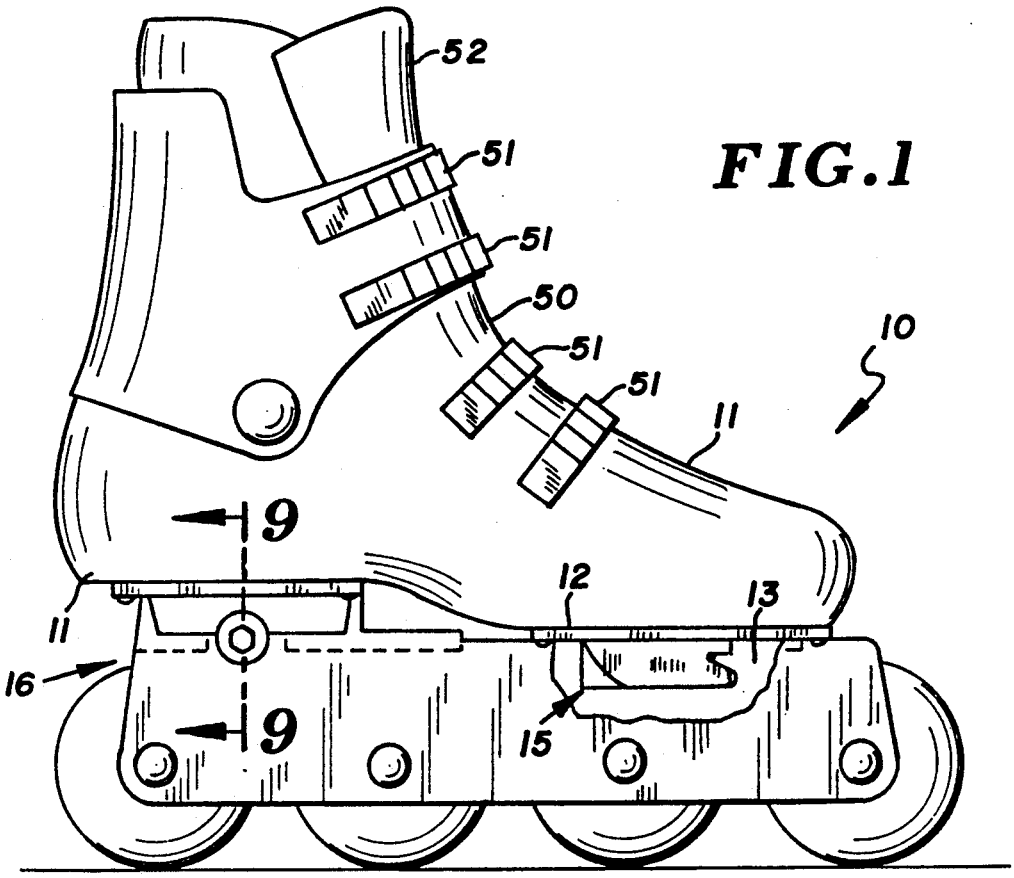
FIG. 1 is a side elevational view of a skate assembly in accordance with the present invention, and illustrating the assembly with an in-line roller member securely held in detachable relationship therewith.
Figure 2:
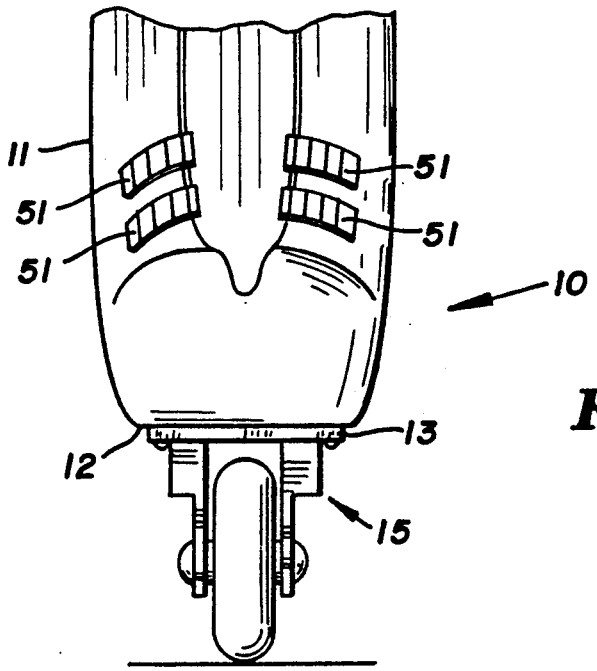
FIG. 2 is a front elevational view, partially broken away, and illustrating the manner in which the blade support is attached to the shoe.

In accordance with the preferred modification of the present invention, and with particular attention being directed to FIGS. 1-4 of the drawings, the skate assembly generally designated 10 comprises a shoe body 11 having a sole plate 12 secured thereto, with toe attachment 13 and heel attachment 14 being secured to the sole plate 12. Coupling means such as rivets are provided for securing a wearer's surface blade support subassembly as at 13A and 14A for attachment to the shoe, with the coupling means per se being shown generally at 15 and 16. In the view of FIG. 1, these coupling means are shown partially in phantom and partially in section, and will be described more fully hereinafter. With continued attention being directed to FIGS. 3 and 4, it will be observed that the heel attachment pads 14 includes a recessed zone as at 18, with this recessed zone containing a cam ramp or cam holding surface as at 19 molded into the attachment pad 14. It will be noted that the details of the camming rail for the toe includes a retaining notch as at 21, and a flat wear surface as at 23. This arrangement will be described more fully hereinafter.

The shoe 11, as illustrated above, is designed of stable and utilitarian material. The shoe includes the base portion and instep area as at 50, together with coupling or closure members 51-51. Closure members are conventionally utilized in the art, and capture and otherwise retain tongue 52 in position for providing comfort to the user.

With attention being directed to FIGS. 7, 8, 9 and 10 of the drawings, it may be seen that the coupling means for securing the heel blade support subassembly to the shoe includes complementary rotatable cam member 24 which is coupled to the heel attachment member 25. Rotatable cam 24 is designed to pivot about the axis of coupling bolt 25, and since it is eccentrically disposed, it is designed to mate with cam ramp 19. Means for rotating are shown as at 22, with these rotation means comprising a hex socket arrangement as at 26 to which rotatable cam 24 is fixedly secured. Alternatively, a Phillips-head or blade-head arrangement utilizing other forms of engagement, including levers, may be utilized in lieu of the hex socket arrangement illustrated at 26.

Figure 10:
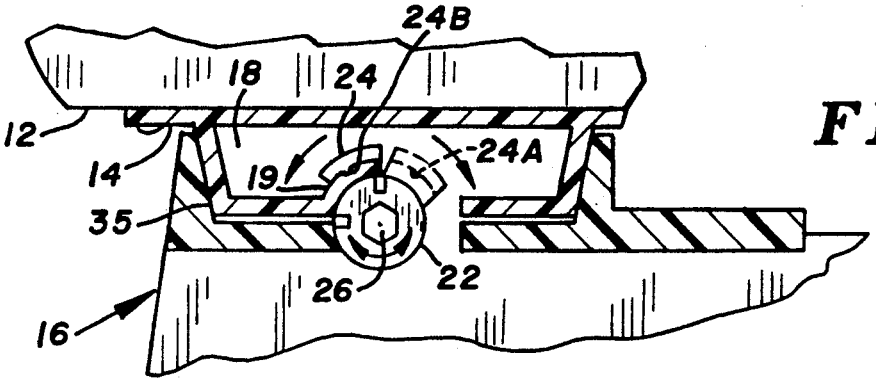
FIG. 10 is a vertical sectional view taken along the line and in the direction of the arrows 10—10 of FIG. 9.
Figure 11:
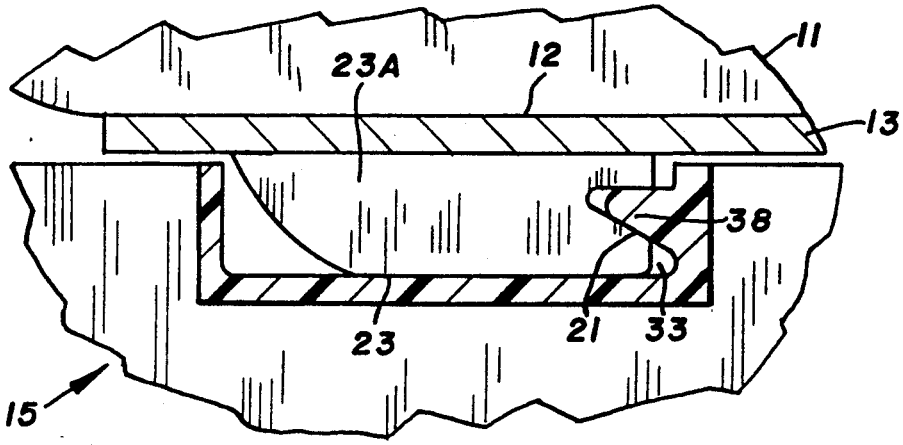
FIG. 11 is a view similar to FIG. 10, and illustrating the camming rail utilized in the toe portion of the assembly, and further illustrating the manner in which the wedged ramp portion of the wheel carrier is placed into engagement with the camming ramp.
Figure 12:
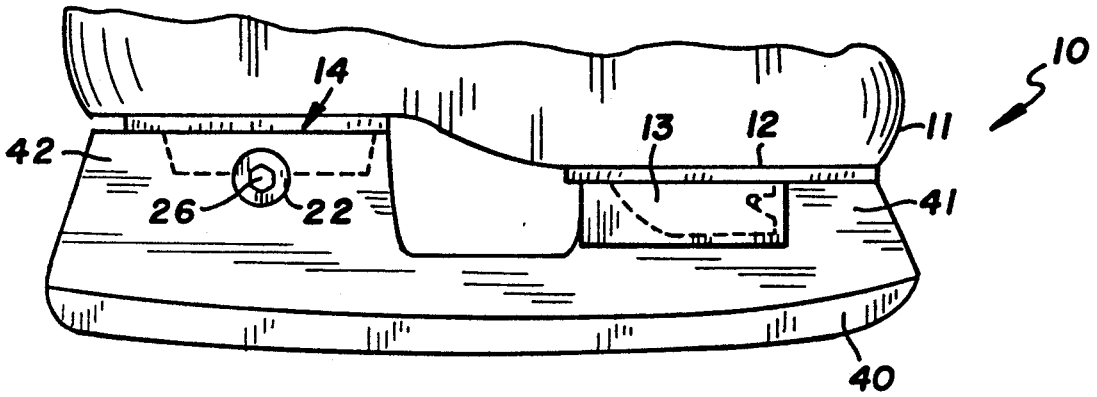
FIG. 12 is a partial side elevational view and illustrating an ice blade assembly being coupled to the shoe portion illustrated in FIGS. 1-11 hereinabove.

With continued attention being directed to FIG. 10 of the drawings, it will be observed that the surface of rotating cam 24 is provided with a small projection such as at 24A, with the projection 24A mating with a complementary groove 24B formed in cam holding surface 19.

In certain instances, it may be desirable to employ the rotatable cam attaching system for both toe and heel pieces. The combination arrangement illustrated in the embodiment of FIGS. 1-13, for example, also provides a desirable arrangement.

Figure 9:
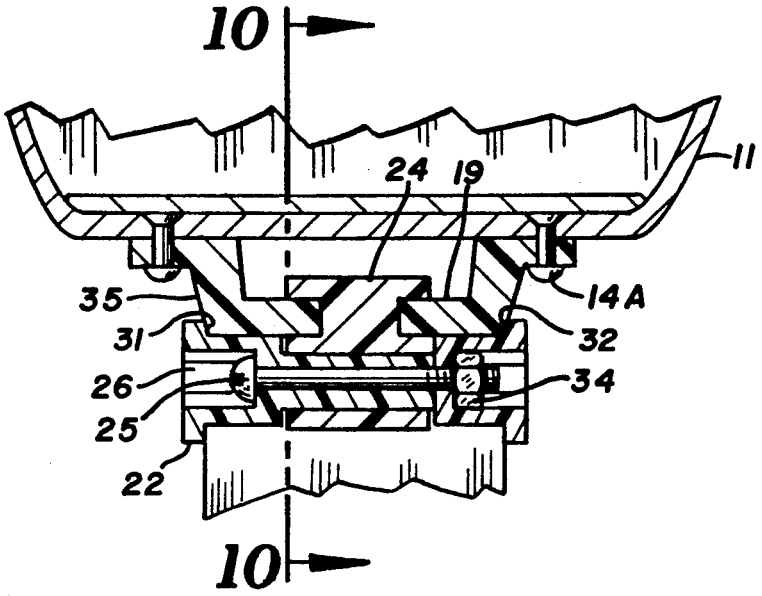
FIG. 9 is a vertical sectional view of the camming ramp attachment means utilized at the heel portion of the shoe, with FIG. 9 being taken along the line and in the direction of the arrows 9—9 of FIG. 1.

With continued attention being directed to FIGS. 5 and 6 of the drawings, the toe and heel attachment members each include a truncated pyramidal anchoring assembly as at 28 and 29, with the assembly being provided with inwardly tapering flange surfaces which define a contact zone for mating engagement with a complementary truncated pyramidal opening or concavity formed in the blade attachment means, such as illustrated at 31 and 32 in FIG. 9, and at 33 in FIG. 8.

Turning now to the corresponding coupling means which form a portion of the blade support subassembly, hex socket 26 is designed as a hex-shaped cam drive arrangement or member. The hex socket, as illustrated at 26, is designed to receive a hex drive key for achieving cam rotation and releasable assembly of surf ace blade support with the shoe. Coupling bolt 25 and nut 34 retains cam drive assembly in place, and, in turn, retains and controls the disposition of rotatable cam 24. A cam location reference mark may be employed, if desired, in order to alert the user to the relative dispositions of the cam 24 and its mating surface 19.

It will be observed that the toe and heel attachment pads are in the form of tapered flanged mounts, such as illustrated at 35 in FIGS. 3 and 5 and at 36 in FIG. 6. The toe and heel attachment pads each include tapered sides, with these tapered sides providing a tight wedge fit between the mating surfaces of the toe and heel attachment pads and the blade support subassembly member.

The camming rail or retaining notch provided at the forward end of the toe attachment is designed to rigidly hold and otherwise secure the complementary notch ramp projection 38 in place. Flat contact surface 23 of camming or retaining rail 23A is provided in order to accommodate a secure mating fit. In actual use and operation, the notch ramp projections 38 are initially engaged with the camming rails, and thereafter the heel portion is snugly set into place and camming ramp surface 24 is rotated into firm engagement with cam holding surface 19 to complete the attachment procedure. A similar attachment arrangement is utilized, of course, when either an in-line roller assembly or an ice blade is employed as the surface blade support. The surface blade support subassembly, as indicated, may be designed with an ice blade such as ice blade 40 (FIG. 12) or with in-line rollers secured in a frame as in FIGS. 1-11 and 13. The term "surface blade support subassembly" is designed to refer to either arrangement.

While the camming rail or retaining notch shown at the forward end of the toe attachment is illustrated with a pair of camming or retaining rails in place, such as camming rail 23A. In certain instances, for added durability and tightness of fit, three or more such camming rails may be employed.

In either the ice blade or in-line roller application, the blade support subassembly includes frame means having a surface contact member secured thereto. The attachment means in the ice skate model is shown at 41 and 42. As has been indicated, each of these assemblies is provided with an identical blade support anchoring cam ramp for rotatable mating contact with the corresponding cam ramp molded into the blade mount. Through this combination of components, firm cooperative mounting is achieved between the shoe and the toe and heel attachment pads. In this connection, it will be noted that the surface blade support subassembly includes such a frame means for ice blade model shown in FIG. 12, with the frame means having toe and heel pad receiving cavities formed therewithin. These arrangements are arranged to firmly receive and retain toe and heel attachment pads respectively in firmly but releasable disposition therewithin.

Figure 13:
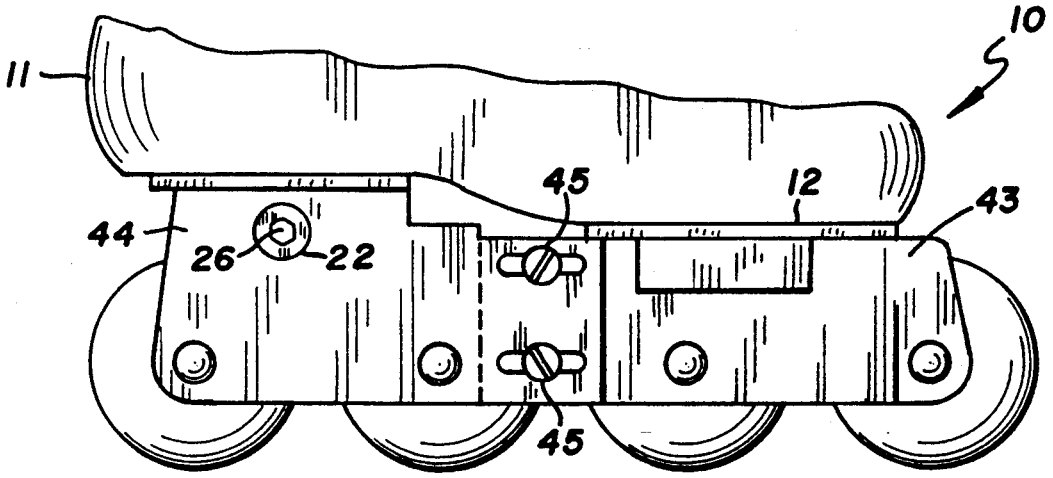
FIG. 13 is a partial side elevational view of a modified form of the assembly illustrated in FIG. 1, and showing one embodiment of an adjustable length feature of the in-line roller.

As indicated earlier, in-line roller frame may be made longitudinally adjustable, and one such means of facilitating this feature is to render the frame telescopically adjustable along its longitudinal axis. Such an arrangement is illustrated in FIG. 13, with the frame 38 being comprised of a forward segment 43 and a trailing segment 44, with through-bolts being provided as at 45-45 for joining segments 43 and 44 together, one to the other. Also, as indicated earlier, longitudinal adjustment of blade length may be achieved in this fashion, thereby making it possible for the user to employ a single blade with a variety or selection of shoe sizes. When longitudinally adjustable in a telescoping fashion, as illustrated in FIG. 13, complementary longitudinally disposed projections and cavities will be provided in order to retain longitudinal rigidity and stability.

The shoe 11 as described hereinabove is fabricated of stable and utilitarian material. Shoe 11, in the embodiment of FIG. 13, includes the conventional base portion and instep area as at 50, together with coupling or closure members 51-51 of the type conventionally utilized to capture and otherwise retain tongue 52 in position.

Figure 14:
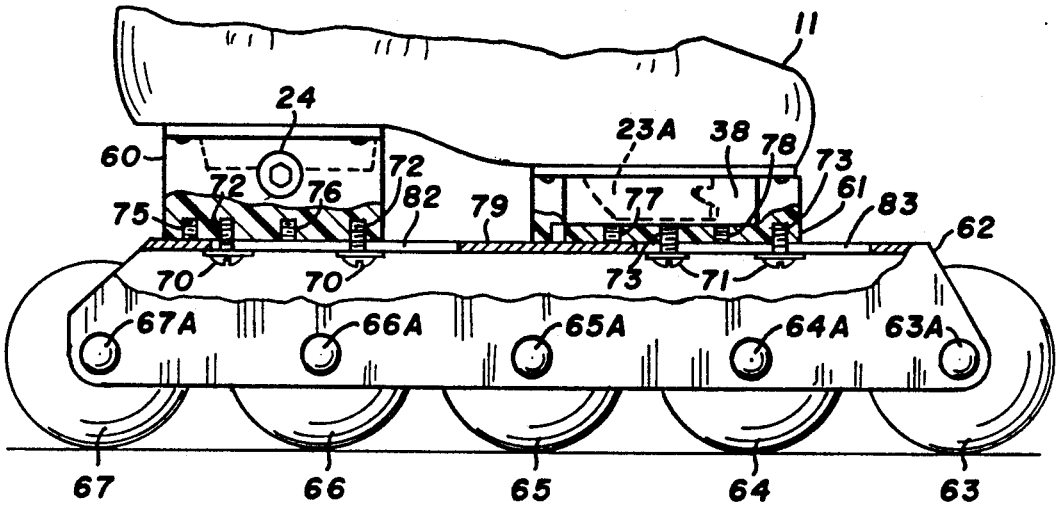
FIG. 14 is a side elevational view of a modified form of the assembly illustrated in FIG. 1, and showing a second embodiment of an adjustable length feature of the in-line roller.
Figure 16:
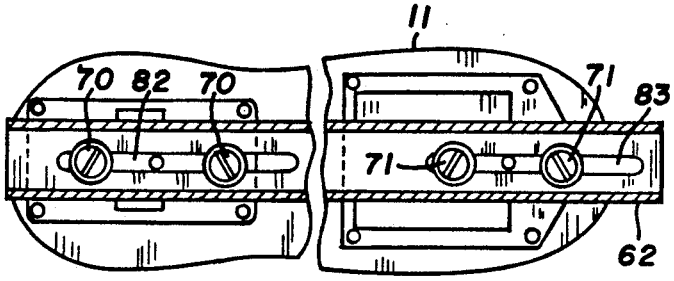
FIG. 16 is a fragmentary bottom plan view of the embodiment illustrated in FIGS. 14 and 15, and illustrating the toe and heel segments of the device illustrated in FIG. 14 with the center portion being broken away.
Figure 15:
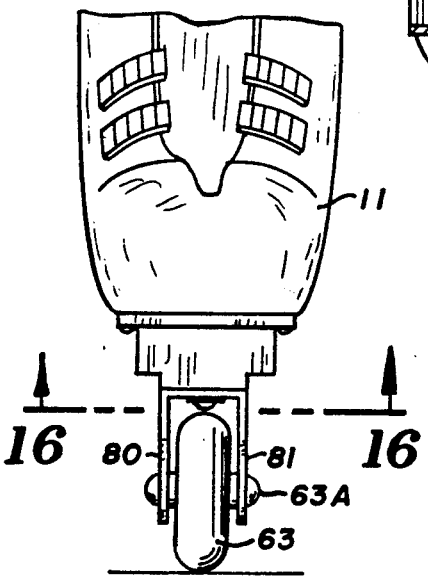
FIG. 15 is a partial front elevational view, partially broken away, illustrating the embodiment illustrated in FIG. 14.

Attention is now directed to the embodiment illustrated in FIGS. 14, 15 and 16 wherein shoe 11 equipped with coupling enclosure members 51-51 is illustrated. Shoe 11 in the embodiment of FIGS. 14-16 is essentially equivalent to that illustrated in the embodiments of FIGS. 1-13, with the exception of the incorporation of heel piece 60 and toe piece 61. Heel piece 60 and toe piece 61 are designed to receive and retain in place longitudinally adjustably positionable wheel frame 62 for wheel members 63, 64, 65, 66 and 67, each of which is journaled for rotation within the side walls of wheel frame 62 such as at 63A, 64A, 65A, 66A and 67A. In order to couple wheel frame 62 onto heel piece 60, screws 70-70 are employed, with toe piece 61 being utilized to accommodate screws 71-71.

With continued attention being directed to FIG. 14, and specific attention being directed to FIG. 16 of the drawings, attachment screws 70-70 and 71-71 are passed through bores such as at 72-72 and 73-73 respectively. A plurality of additional bores are arranged in spaced relationship along the center portion of wheel frame 62, such as at 75, 76, 77 and 78. Wheel frame 62 is in the form of a channel member with a base plate portion 79 and a pair of flange members 80 and 81 extending therefrom. In this arrangement, with the shoe or boot size increment being arranged in a predetermined hole sequence pattern, mounting screws may be utilized to secure a shoe such as shoe 11 onto wheel frame 62 with accommodations being made for different shoe sizes. In this fashion, a single wheel frame size may be employed to accommodate several different shoe sizes, and the attachment may be made appropriate for the user by varying the position of the mounting screws within the wheel frame. In the arrangement illustrated in FIG. 14, heel piece 60 and toe piece 61 arrange and provide an appropriate mounting plane for the attachment of wheel frame 62 to the boot.

As is indicated in FIGS. 14 and 16, slots may be provided as at 82 and 83 to provide for additional flexibility and/or adjustment in the mounting of wheel frame 62 onto the boot 11. Slots may also be utilized to selectively place mounting screws such as 70-70 and 71-71 so as to provide for longitudinal adjustment of the mounting position and/or point of wheel frame 62 relative to boot 11. Personal preferences of the user may be accommodated in this fashion.

As is apparent in the modification of FIGS. 14–16, the rotatable cam member 24 described hereinabove in connection with the embodiments of FIGS. 1–13 is employed. Furthermore, the toe attachment in the form of the camming rail arrangement described hereinabove is employed, such as is shown at the notched ramp projections 38 and complementary camming and/or retaining rails 23A. The flat contact surface 23 provides for strong, durable support.

Referring now to FIG. 17, an alternative preferred embodiment of the invention is shown illustrating a side elevational view of a skate assembly having a reversible wheel assembly. A key feature of this alternative embodiment is that the in-line wheel assembly can be securingly attached to the boot in a forward or backward direction. Thus, when the wheels of the blade assembly begin to wear, which commonly occurs to the front wheel the most after time, the blade assembly can be reversed such that the wheel that was formerly the front wheel is now disposed beneath the heel. Thus, the usable life of the in-line skate assembly is extended. Further, no additional attachment tools are needed as the in-line skate assembly can be secured or removed from the boot by rotating a pair of levers which are coupled to a camming arrangement, which form an intrical portion of the wheel assembly, as will now be described in considerable detail.

Figure 18:
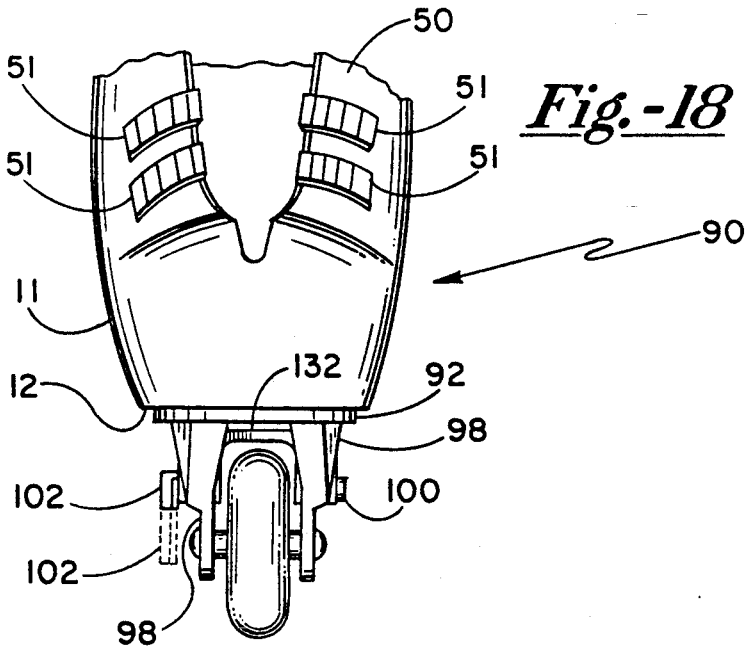
FIG. 18 is a front elevational view taken along line 18-18 shown in FIG. 17.
Figure 19:
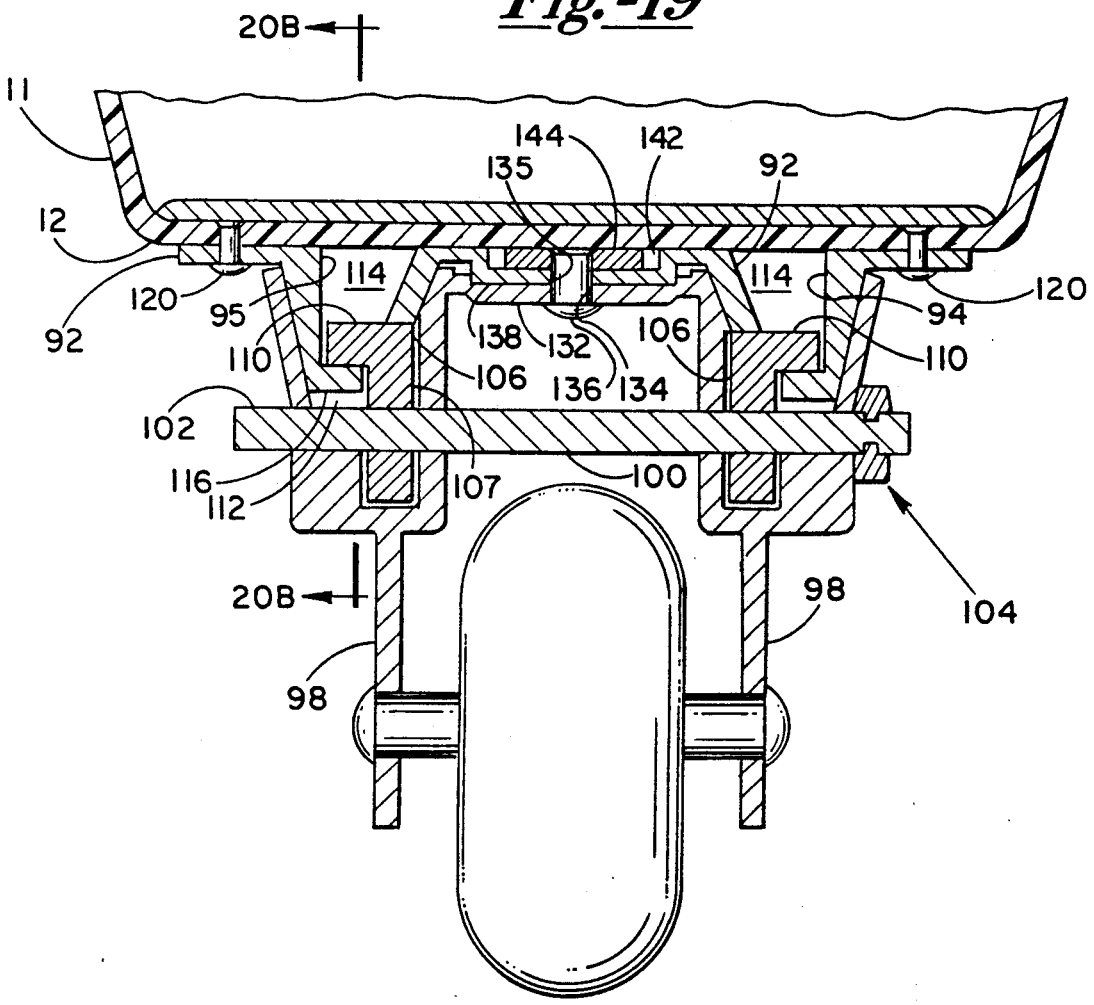
FIG. 19 is a vertical sectional view taken along line 19-19 shown in FIG. 17 illustrating the cam attachment means having a pair of cams defined in the wheel assembly pockets, which cam attachment means is similar at both the toe and heel locations.

Referring to FIGS. 17 and 18, a skate assembly is generally designated at 90 and comprises a shoe body 11 having a sole plate 12 secured thereto. A toe attachment 92 and heel attachment 93 are each secured to the sole plate 12, each comprised of a rigid material such as metal or plastic. Each attachment 92 and 93 is defined in the shape of an inverted U-shaped bracket. A blade assembly receiving notch is defined by each respective attachment bracket 92 and 93 by a pair of rigid side members 94 and 95 (FIG. 19). A symmetrical in-line roller skate assembly 96 including a pair of opposing rigid mounting plates 98 has pockets defined therein for receiving conforming side members 94 and 95 of brackets 92 and 93. Assembly 96 can be secured to brackets 92 and 93 in either a forward or backward arrangement. In-line blade assembly 96 is secured to the respective attachment 92 and 93 by rotating a respective securing bolt 100 via an L-shaped handle 102. By rotating each handle 102 approximately 90 degrees, a pair of cams 106 securingly attached each bolt 100 and residing in the pockets of side members 96 are concurrently rotated therewith. Each cam 106 includes an opposing flange 110 which slides in an arcuate path within the respective pocket defined in each side bracket member 98 of blade assembly 96. In the locked position, cams 106 slide above and engage a shoulder of side members 94 and 95 to secure assembly 96 to the attachment brackets 92 and 93.

Referring now to FIGS. 19 and 20, this unique cam arrangement for selectively securing the reversible and symmetrically designed in-line skate assembly 96 to each mounting attachment 92 and 93 is shown, and will be described in considerable detail. FIG. 19 represents a vertical sectional view of the camming attachment means utilized at the toe portion of the shoe as shown in FIG. 17. However, it is noted that the camming arrangement is substantially identical for both the toe and heel portion of the shoe. The primary difference between heel bracket 93 and bracket 92 is the extra vertical extension of bracket 93 to extend to the heel of boot 11 as shown. Thus, the in-line blade assembly 96 is reversible and interchangeable as previously discussed.

Figure 20A:
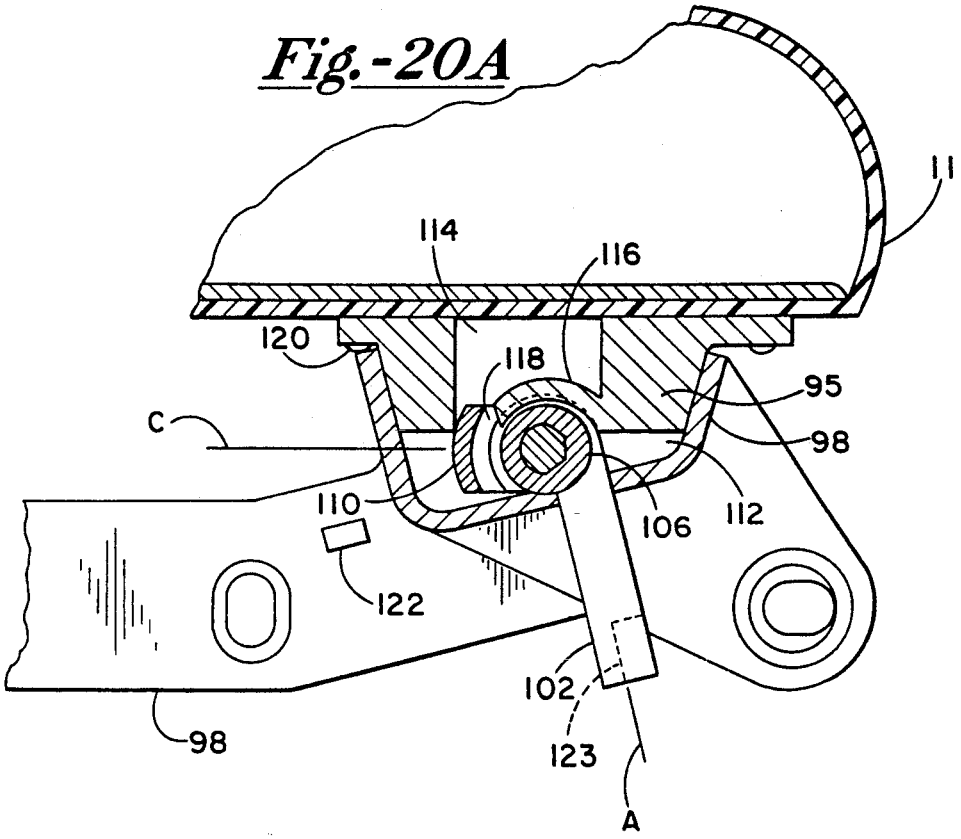
Figure 20B:
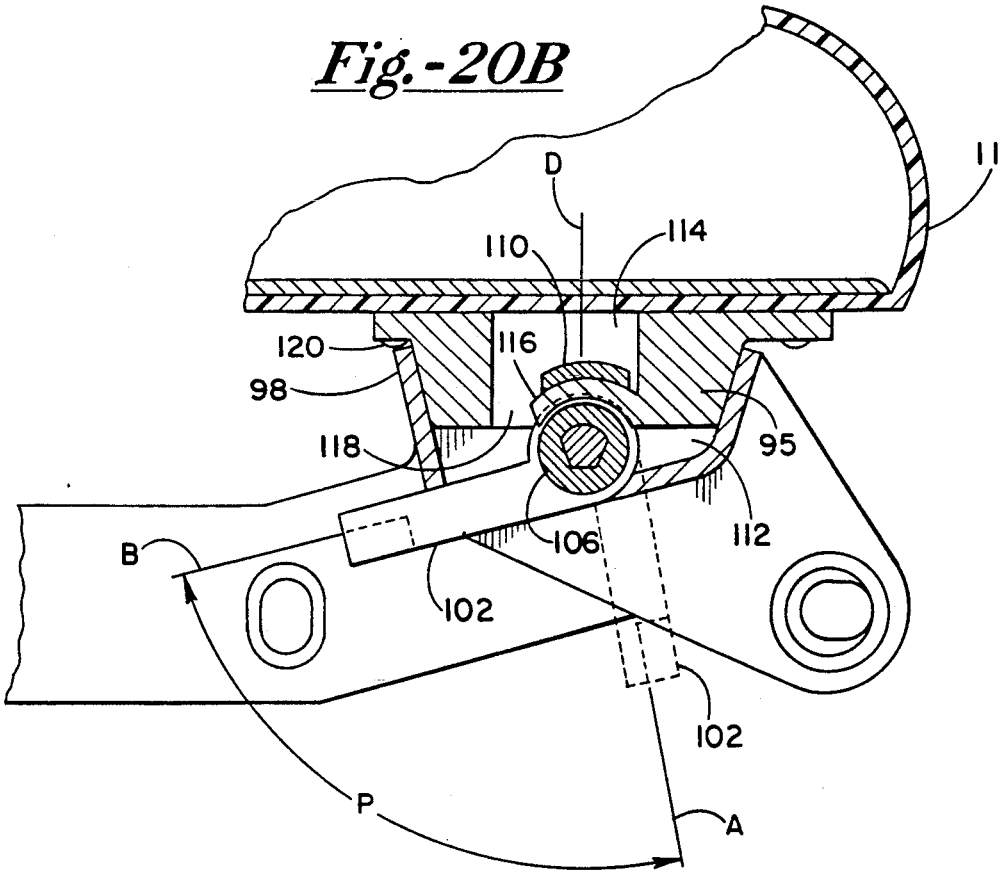

Still referring to FIG. 19, the vertical sectional view taken at 19-19 shown in FIG. 17 further illustrates the camming attachment means. A pair of cams 106, each comprised of a piece of rigid material such as aluminum, is securingly attached or bonded about and along each end of bolt 100. Each cam 106 has a conforming shaped opening defined therethrough and keyed for receiving bolt 100. (FIG. 20A and 20B). Thus, as bolt 100 is rotated via handle 102, each cam 106 rotates therewith. Each cam 106 is received within a generally inverted elongated frusto-pyramid shaped pocket 112 defined in each side plate 98. Each side member 94 and 95 of each brackets 92 and 93 have a generally inverted elongated frusto-pyramid shape conforming to the shape of pocket 112, and are hollowed to form a pocket 114 therein. Due to the conforming shapes of members 94 and 95, and receiving pocket 112, by utilizing a pair of cams 106, the wheel assembly is securingly attached to boot 11 with very little play. However, it is recognized the present invention can be practiced with only one cam 106 for each attachment member 92 or 93.

Each cam 106 includes a web 107 extending to a laterally extending flange 110, each extending away from the other. Cams 106 are received within a respective pocket 112 defined in each side plate 98 of in-line blade assembly 96, as further illustrated in FIGS. 20A and 20B. When initially attaching in-line wheel assembly 96 to each attachment bracket 92 and 93, handle 102 of bolt 100 is in position A, and each flange 110 is in position C as shown in FIG. 20A. To secure in-line blade assembly 96 to each attachment bracket, such as attachment bracket 92 as illustrated in FIGS. 19, 20A and 20B, each handle or lever 102 is rotated 90 degrees from position A to position B. Consequently, each flange 110 will be rotated from position C to position D, as illustrated in FIG. 20B. Each flange 110 rotates through an L-shaped slot 118 which is defined through the bottom of each side member 94 and 95 from pocket 114, as shown, wherein flange 110 engages an arcuate shoulder 116 of respective side member 94 and 95 in a close friction fit. During rotation, handle 102 traverses arcuate path P as shown in FIG. 20B. It is noted that each flange 110 is concurrently rotated by rotating bolt 100 such that each flange rotates from position C to position D into pocket 112 and above shoulder 116 in each respective side member 94 and 95, as shown in FIG. 19. A lock washer 104 is provided and engages an annular notch at the distal end of bolt 100 such that bolt 100 does not laterally slide within the wheel assembly 96, as shown in FIG. 19. However, any other form of lateral restraining means is suitable.

Referring to FIGS. 20A and 20B in view of FIG. 17, it is noted each shoulder 116 of each side members 94 and 95 extends toward each other. Thus, there are a total of four slots 118 and four shoulders 116 provided for adapting to each in-line blade assembly 96. Still referring to FIG. 17, to attach in-line blade assembly 96 to boot 11, upon inserting each side member 94 and 95 into respective pockets 112 of in-line blade assembly 96, the left (heel) bolt 100 is rotated counterclockwise to lock the rear portion of in-line blade assembly 96 to attachment bracket 93, as shown. Conversely, the right (toe) bolt 100 is rotated in the clockwise direction to lock and secure the front portion of in-line blade assembly 96 to front attachment bracket 92, as shown. Since the design of the slots 118 and shoulders 116 of brackets 94 and 95 are symmetrically arranged when adapted to boot 11, in-line blade assembly 96 can be attached to brackets 92 and 93 in a reversible orientation.

This arrangement is suitable for both in-line skate blade assemblies, and for ice skate blades as well. Thus, the design is versatile and suitable to both types of blade assemblies.

Referring again to FIGS. 20A and 20B, the conforming shapes of the inverted frusto-pyramid shaped members 94 and 95, and pockets 112, limit the amount of play of side members 94 and 95 within the pockets 112. When blade assembly 96 is adapted to each attachment bracket 92 and 93, each bolt 100 is disposed closely proximate the bottom of shoulder 116 as shown to provide a rigid attachment. Thus, it is easy to attach the blade assembly 96 to each attachment bracket 92 and 93 such that each bolt 100 can be rotated via handle 102. Also shown is the unique cross section shape of bolt 100 and the opening defined through cams 106 to facilitate a keying arrangement. The key is provided by the openings have three sides extending 180 degrees, and an arcuate shape the other 180 degrees.

Referring to FIG. 19, while each part is illustrated as being comprised of metal, rigid plastics are suitable for use as well. Hence, limitation to metal parts is not to be inferred. Also shown in FIG. 19 is a plurality of rivets 120 used for securingly attaching attachment bracket 92 to attachment plate surface 12 of boot 11. However, other fasteners including screws, or bonding the brackets directly to the boot is suitable as well. Referring to FIG. 20B, it is noted that the path of rotation P for handle 102 is such that one can easily grasp the handle 102 while it is proximate the bottom of the boot such that it can then be rotated downwardly to position A as shown. As shown in FIG. 18, handle 102 extends a predetermined distance from side plate 98 to facilitate grasping.

Referring to FIGS. 20A and 20B, a pair of smoothed protrusions 122 are integrally defined in each side plate 98 to restrict the respective lever 102 from inadvertently rotating downward while skate assembly 90 is in use. Each handle 102 has a recess 123 on an inside surface thereof conforming to the shape of respective protrusion 122. To release wheel assembly 96 from the boot, one needs to urge each lever 102 over and beyond the respective protrusion 122.

Now referring to FIG. 21, a top view 21-21 shown in FIG. 17 is illustrated. Each pocket 112 is defined by inner walls 125 tapering inward to bottom surface 126 and 127, wherein cam 106 is disposed above surface 127. A rigid brace 124 is disposed between each side plate 98 for maintaining a predetermined spacing therebetween, and to insure structural integrity of the wheel assembly frame. A brace or web 130 and 132 are integrally formed with side plates 98, each extending between the ends of each side plate 98, and also maintain a predetermined spacing therebetween for receiving wheels. Each web 130 and 132 has an aperture 134 defined through a central location thereof and aligned with an aperture 135 of either bracket 92 or 93 for receiving a screw 136, or an other suitable fastener, for securing frame assembly 98 directly to boot 11 when cams 106 are eliminated, as shown in FIG. 19. A rectangular recess 138 is defined in each web 130 and 132 conforming to a rectangular protrusion 140 of each mounting bracket 92 and 93, as shown in FIG. 19. A threaded nut 144 is positioned and secured in a pocket 142 defined between each protrusion 140 and plate 12 for receiving screw 136, for providing an alternative fastening means to the camming arrangement.

Referring to FIG. 22, a bottom view of boot 11 and attachment bracket 92 is shown. Each side member 94 and 95 is comprised of an elongated generally frusto-pyramid or trapezoidal shaped member, the sides of which taper to a pair of flat surfaces 148, and the underside of shoulder 116. L-shaped slot 118 and pocket 114 receive the web 107 and flange 110 of respective cam 106 of skate assembly 96 when side members 94 and 95 are inserted into respective pockets 112 of skate assembly 96, and when the cams 106 are rotated by handle 102. The attachment bracket 93 adapted to the heel of boot 11 is identical to bracket 92 (with the exception of the upper extension of heel bracket 93), but is rotated 180 degrees from the shown arrangement of bracket 92 such that wide portion of slots 118 are disposed closest to the wide portions of slots 118 of bracket 92. Thus, a symmetrically designed boot attachment arrangement is defined by brackets 92 and 93 such that wheel assembly 96 can be adapted to brackets 92 and 93 in either a forward or reward direction, thus providing a reversible feature of wheel assembly 96.

In summary, a key feature of this alternative embodiment is that the blade assembly, whether a in-line roller skating blade assembly or a ice skating blade assembly, can be attached to the boot in either direction due to the symmetrically designed and arranged attachment brackets 92 and 93, and due to the identical cams and attachment bolts shown. Further, no additional parts are required, such as an allen wrench or a screw driver, to rotate the cam assembly. Hence, one only needs to grasp and rotate the handle 90 degrees to concurrently rotate the respective cam and securingly lock the wheel assembly onto each respective attachment bracket. This procedure is quick and convenient, as will be appreciated by the user.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

It will be appreciated that those skilled in the art may depart from the detail of the apparatus illustrated herein without actually departing from the spirit and scope of the present invention.

What is claimed is:

1. In a skate assembly comprising a shoe having a sole plate, toe and heel attachment means secured to said sole plate, and means for selectively securing a wearer's surface blade support subassembly to said toe and heel attachment means, said skate assembly being further characterized in that:

said blade support assembly includes a frame having a first and second end, said first and second end having a first and second coupling means, respectively, each said first and second coupling means being identical so that they can be coupled to either the toe or heel attachment means such that said blade support subassembly is securingly adaptable to said shoe in two positions.

2. The skate assembly as specified in claim 1 wherein each said first and second coupling means comprises a rotatable cam locking member rotatable about a camming axis.

3. The skate assembly as specified in claim 2 wherein said rotatable cam has a web extending radially from said camming axis to a laterally extending camming flange, said camming flange being selectively securable to either said heel or toe attachment means upon rotation of said cam.

4. The skate assembly as specified in claim 3 wherein each said heel and toe attachment means has a slot for receiving said respective camming flange upon rotation of said camming means.

5. The skate assembly as specified in claim 4 wherein each said heel and toe attachment means comprise at least one protrusion, and each said first and second coupling means include a recess conforming to each said protrusion of either said heel or toe attachment means.

6. The skate assembly as specified in claim 5 wherein said conforming recess and said protrusion have a generally trapezoidal shape.

7. The skate assembly as specified in claim 5 wherein said slot of said heel and toe attachment means is defined in a lower portion of said respective protrusion.

8. The skate assembly as specified in claim 5 wherein said slot of said heel and toe attachment means defines a shoulder, said shoulder adapted to mate with said camming flange of said respective camming means upon rotation thereof.

9. The skate assembly as specified in claim 8 wherein said shoulder has an arcuate shape.

10. The skate assembly as specified in claim 5 wherein one said rotatable cam is disposed in each said recess of said first and second coupling means.

11. The skate assembly as specified in claim 1 wherein each said first and second coupling means include a first surface conforming to both side heel and toe attachment means, and a fastener for selectively securing said surface blade support subassembly to said heel and toe attachment means.

12. The skate assembly as specified in claim 11 wherein said first surface comprises a recess.

13. The skate assembly as specified in claim 2 further comprising a handle coupled to each said rotatable cam locking member.

14. The skate assembly as specified in claim 13 further comprising locking means for selectively securing each said handle in a predetermined first position.

15. The skate assembly as specified in claim 14 wherein said locking means comprises a pair of protrusions each extending from said frame.

16. The skate assembly as specified in claim 1 wherein said blade support subassembly includes an in-line roller blade.

17. The skate assembly as specified in claim 1 wherein said blade support subassembly includes an ice skating blade.

18. In a skate assembly comprising a shoe having a sole plate, toe and heel attachment means secured to said sole plate, and means for selectively securing a wearer's surface blade support subassembly to said toe and heel attachment means, said skate assembly being further characterized in that:

said blade support assembly includes a frame having a first and second end along a longitudinal axis, said assembly having a lateral axis disposed across a center therebetween to define an assembly left half and an assembly right half, said first and second assembly halves having a first and second coupling means, respectively, each said first and second coupling means located equal distances from said assembly lateral axis and adaptable to either the toe or heel attachment means such that said blade support subassembly is securingly adaptable to said shoe in two positions, wherein said blade assembly is symmetric about said lateral axis such that it is identically disposed with respect to said shoe when coupled to said sole plate in either said two positions.

19. The skate assembly as specified in claim 18 wherein each said first and second coupling means comprises a rotatable cam locking member rotatable about a camming axis, wherein said rotatable cam has a web extending radially from said camming axis to a laterally extending camming flange, said camming flange being selectively securable to either said heel or toe attachment means upon rotation of said cam.

20. The skate assembly as specified in claim 19 wherein each said heel and toe attachment means has a slot for receiving said respective camming flange upon rotation of said camming means.

21. The skate assembly as specified in claim 20 wherein each said heel and toe attachment means comprise at least one protrusion, and each said first and second coupling means include a recess conforming to each said protrusion of either said heel or toe attachment means.

22. The skate assembly as specified in claim 21 wherein said conforming recess and said protrusion have a generally trapezoidal shape.

23. The skate assembly as specified in claim 21 wherein said slot of said heel and toe attachment means is defined in a lower portion of said respective protrusion.

24. The skate assembly as specified in claim 21 wherein said slot of said heel and toe attachment means defines a shoulder, said shoulder adapted to mate with said camming flange of said respective camming means upon rotation thereof.

25. The skate assembly as specified in claim 24 wherein said shoulder has an arcuate shape.

26. The skate assembly as specified in claim 21 wherein one said rotatable cam is disposed in each said recess of said first and second coupling means.

27. The skate assembly as specified in claim 18 wherein each said first and second coupling means include a first surface conforming to both side heel and toe attachment means, and a fastener for selectively securing said surface blade support subassembly to said heel and toe attachment means.

28. The skate assembly as specified in claim 27 wherein said first surface comprises a recess.

29. The skate assembly as specified in claim 19 further comprising a handle coupled to each said rotatable cam locking member.

30. The skate assembly as specified in claim 29 further comprising locking means for selectively securing each said handle in a pre-determined first position.

31. The skate assembly as specified in claim 30 wherein said locking means comprises a pair of protrusions each extending from said frame.

32. The skate assembly as specified in claim 18 wherein said blade support subassembly includes an in-line roller blade.

33. The skate assembly as specified in claim 18 wherein said blade support subassembly includes an ice skating blade.

* * * * *